United States Patent [19]

Unterstein

[11] Patent Number: 4,659,037

[45] Date of Patent: Apr. 21, 1987

[54] WING DEPLOYING SYSTEM COMPRISING AN AIRBAG

[75] Inventor: Klaus Unterstein, Duesseldorf, Fed. Rep. of Germany

[73] Assignee: Rheinmetall GmbH, Duesseldorf, Fed. Rep. of Germany

[21] Appl. No.: 769,178

[22] Filed: Aug. 26, 1985

[30] Foreign Application Priority Data

Sep. 5, 1984 [DE] Fed. Rep. of Germany ..... 3432614

[51] Int. Cl.[4] ..... F42B 15/053

[52] U.S. Cl. ..... 244/3.28; 244/49

[58] Field of Search ..... 244/3.27, 3.28, 3.29, 244/46, 49, 219 A, 213; 267/64.27, 122, 118; 92/90, 91, 92; 102/384, 340, 430, 440, 342, 351, 357

[56] References Cited

U.S. PATENT DOCUMENTS

| | | | |
|---|---|---|---|
| 3,047,257 | 7/1962 | Chester | 92/92 |
| 3,633,846 | 1/1972 | Biggs, Jr. | 102/384 |
| 4,143,838 | 3/1979 | Holladay | 244/3.28 |
| 4,203,569 | 5/1980 | Marks | 244/3.28 |
| 4,334,657 | 6/1982 | Mattson | 244/3.28 |
| 4,364,531 | 12/1987 | Knoski | 244/3.27 |
| 4,478,150 | 10/1984 | Sayler et al. | 102/430 |
| 4,586,681 | 5/1986 | Wedertz et al. | 244/3.27 |

FOREIGN PATENT DOCUMENTS

| | | | |
|---|---|---|---|
| 7603512 | 10/1976 | Netherlands | 244/3.28 |

*Primary Examiner*—Deborah L. Kyle
*Assistant Examiner*—Michael J. Carone

[57] ABSTRACT

The invention concerns a missile body having a first flight guide and stabilization means mounted on the missile body and a second guide and stabilization means mounted on the missile body in front of the first guide and stabilization means with respect to the direction of flight. The second guide and stabilization means comprise a plurality of wings which are folded inwardly (collapsed inwardly, pivoted inwardly) into the missile body when in their inoperative position. These wings can be pivoted or slid outwardly when in their operative position by means of a collapsed expandable body which is expanded by means of pressurized gas. The pressurized gas is stored in a pressurized gas cylinder mounted within the missile body. The expandable body expands in a radial direction and thereby exerts a force on the wings which causes them to either pivot about a rotatable axis or to move in a radial direction outwardly of the missile body.

6 Claims, 6 Drawing Figures

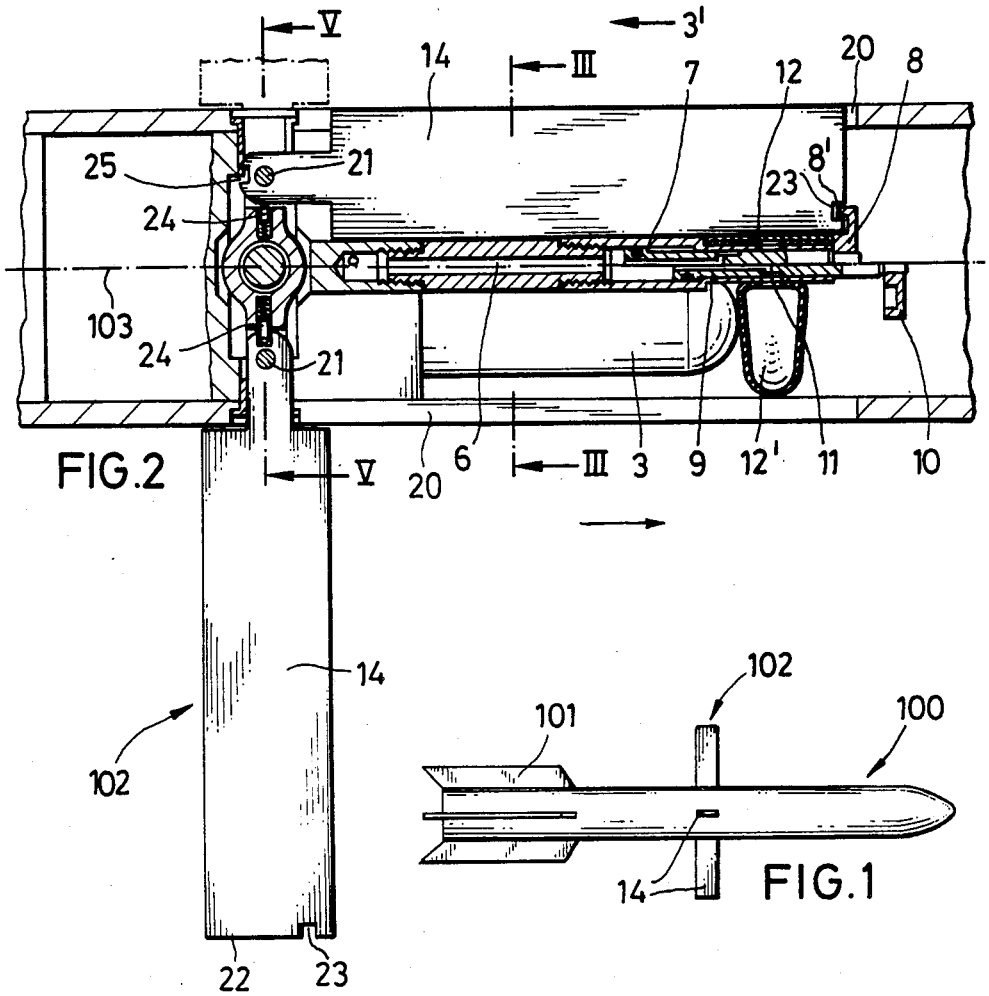
FIG.2
FIG.1
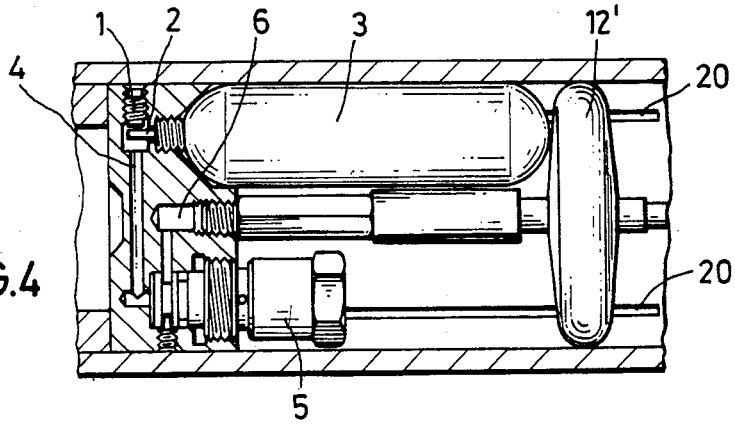
FIG.4

WING DEPLOYING SYSTEM COMPRISING AN AIRBAG

BACKGROUND OF THE INVENTION

The invention relates to a novel improved missile. The term "missile" as used in this application includes rockets fired from rocket launching tubes as well as projectiles fired from gun barrel weapons. Such missiles generally include for their flight stabilization a tail wing or fin-stabilization construction. In order to improve the target impact accuracy of this type of missile, a second wing or fin construction is often used, which construction is arranged in front of the tail construction with respect to the flight direction. This second flight guiding and stabilization mechanism is particularly effective when the wings of the mechanism project substantially from the outer periphery of the missile body.

SUMMARY OF THE INVENTION

It is a principal object of this invention to provide a missile with a second flight guiding and stabilization mechanism which is particularly effective and reliable.

BRIEF DESCRIPTION OF THE DRAWING

With these and other objects in view, which will become apparent from the following detailed description, the present invention, which is shown by example only, will be clearly understood in connection with the accompanying drawing, in which:

FIG. 1 is a schematic side-elevational view of a missile body having tail guide means and second guide means mounted in front thereof in accordance with this invention;

FIG. 2 is a partial cross-sectional view at an enlarged scale of a detail of the missile body in accordance with FIG. 1.

FIG. 4 is an enlarged detailed view, partially in cross-section, of the missile body along the circular sector IV—IV in FIG. 3;

DETAILED DESCRIPTION

Figure 3:
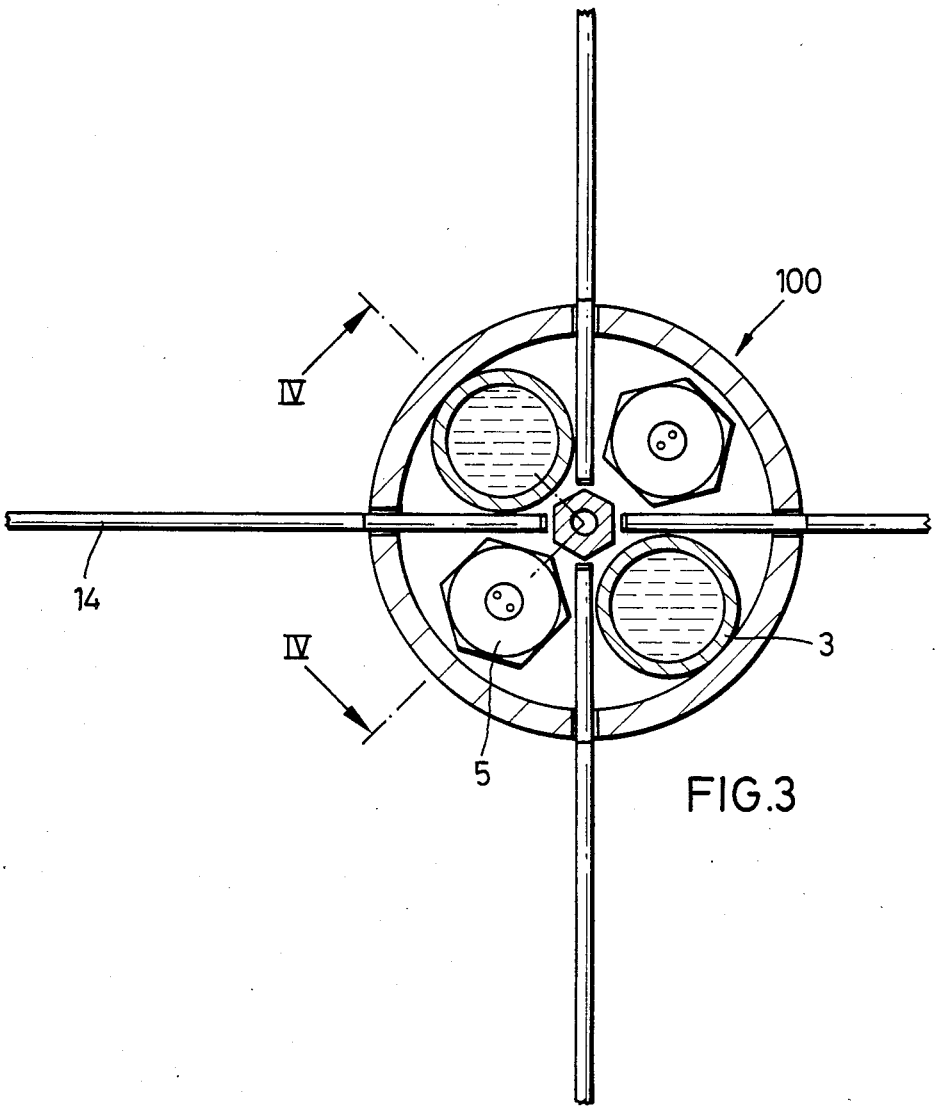
FIG. 3 is a cross-sectional view of the missile body along line III—III of FIG. 2 as seen along the arrow 3' in FIG. 2.
Figure 5:
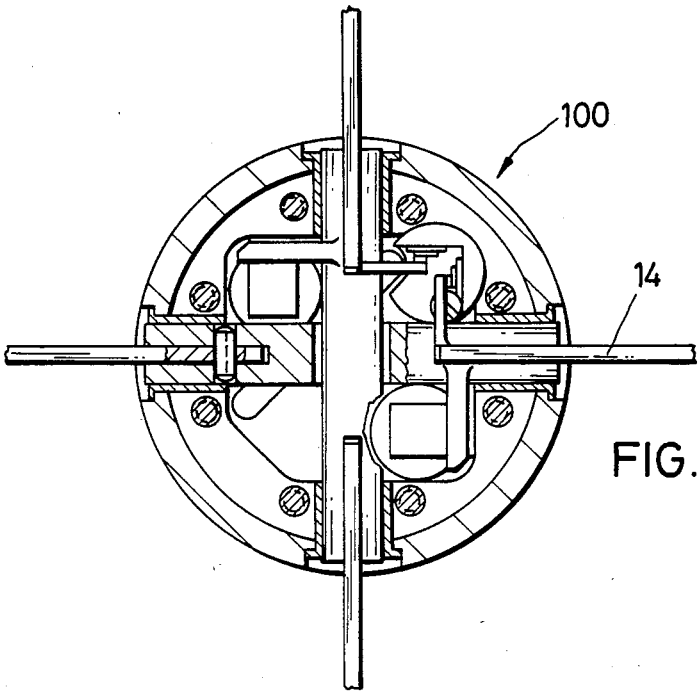
FIG. 5 is a cross-sectional view of the missile body along line V—V in FIG. 2.

FIG. 1 illustrates schematically in side-elevation a missile body 100 having a flight path stabilization means in the form of a tail guide mechanism 101 and a second flight stabilization means 102 in the form of wings 14. The second flight stabilization means 102 are disposed in front of the first rear or tail flight stabilization means 101 with respect to the direction of flight. The second flight stabilization means 102 make possible a particularly precise influencing of the flight path of the missile body 100 over the end phase of its flight. It has been found that the wings 14 are particularly effective when they radially extend substantially beyond the outer periphery of the missile body 100.

In order to permit the use of such wings during the firing of missile bodies 100 from rocket tubes or gun barrels having a predetermined caliber, which corresponds substantially to the exterior diameter (caliber) of the missile body 100, the wings 14 of this second flight stabilization means 102 are at least, during the starting phase of its flight, respectively the firing process, foldable or collapsable inwardly into the missile body 100. These wings are only thereafter, at the latest however at the beginning of the end phase of the flight path, folded or pivoted outwardly, by means which will be described hereinafter, in order to assume their operative position.

FIG. 2 illustrates in a partial sectional view an enlarged detail of the missile body in accordance with FIG. 1. In particular, the middle portion of the missile body where the pivotably mounted wings 14 are disposed, is illustrated in this figure. There is shown one wing 14 in a collapsed inoperative position and another wing 14 in an extended operative position. In its inoperative position the wing 14 is arranged in an axially extending slit 20 disposed in the outer wall of the missile body 100. In order for the wing 14 to reach the operative position from its inoperative position, thereby being disposed normally with respect to the longitudinal axis 103 of the missile boy 100, it must be pivoted about an axis 21. The outward pivoting is achieved advantageously opposite to the flight direction of the missile body 100 so that the air stream forces favor and support the outward pivoting. Particularly heavy demands are made on the means of the second flight stabilization means 102 which effect the outward pivoting of the wings 14 from its inoperative to its operative position. These means must, on the one hand, be as compact as possible so as to require as little space and weight as possible since these means represent a "deadload" which reduces the useful load of the missile body; on the other hand, these means must function reliably, even after a long storage or shelf life, even with the maximum acceleration forces being applied thereto to first of all unfold the folded-in or collapsed wings 14. In accordance with the invention the means for unfolding (outwardly pivoting) the wings 14 include an expandable body (air bag) 12, 12' which in the inoperative position of the wings 14 is disposed in a substantially collapsed condition in the region of the longitudinal axis 103 of the missile body 100 when the wings 14 are in the inoperative position, so that it can be tightly folded (collapsed) in a very confined space. The ends of the wings 14, which face away from the axis 21 when in their stored position in which they are disposed in the slits 20, bear on the folded (collapsed) body 12, 12'. This expandable body or air bag 12, 12' can from this collapsed condition be blown up by means of pressurized gas, whereby it preferably expands in a radial direction into a substantially disc-shaped structure. By means of this blowing up, which occurs in a relatively very short time period with an appropriate pressurized gas supply, a force in the radial direction is exerted onto the ends of the wings 14 so that they pivot about the rotation axes 21 into their operative position, in which they are substantially normal with respect to the longitudinal axis 103 of the missile body 100. Reference number 12 refers to the expandable body (air bag) when in its collapsed condition; reference number 12' refers to that same body (air bag) when in its blown up (expanded) condition. A highly pressurized gaseous medium for expanding the body 12, 12' may be stored in a pressurized gas cylinder 3, which, by way of gas channels 4, 6 and the intermediate switching of an appropriate electrically remote controlled pressure reducing valve 5, is in communication with the expandable body 12, 12'. The pressurized gas cylinder 3 is sealed by means of a gas tight seal 2 until the wings 14 of the flight stabilization means 102 are outwardly pivoted. This seal 2 can be deactivated for the purpose of introducing the outward pivoting of the wings 14 by, for example, a pyrotechnical ignition capsule 1. Before the highly pressurized gas, which streams out of the pressurized gas cylinder 3, can pivot outwardly the wings 14 by blowing up the body 12, 12' and imparting onto this expandable body the shape which is clearly illustrated in FIG. 4, it is necessary to remove a safety, which maintains the wings 14 in their inoperative positions within the axial slits 20. This safety consists of a slider 7 which is slidably mounted in the direction of the longitudinal axis 103 in the gas channel 6. This slider 7 supports a pot-shaped holding disc 8, which engages with its side wall 8' into a recess 23 disposed in the outer edge of the wing 14. After removing the seal 2 the gas streaming out of the pressurized gas cylinder 3 flows via the gas channel 4 and the gas pressure reducing valve 5 also into their gas channels 6 and slidably displaces the slider 7 to such an extent in the direction of the direction of flight along the axis 103 so that the side wall 8' of the pot-shaped holding disc 8 disengages with the recess 23 of the wing 14 and thereby releases the same. The further movement of the slider 7 causes a releasing of a bore 11 in the gas channel 6, thereby placing the latter into communication with the to be blown up (expanded) body 12, 12' permitting its blowing up via the gas channel 6 as a result of the pressurized gas flowing therethrough. By means of the radial expansion of the expandable body 12, 12' the wings 14 are upruptly pivoted outwardly and reach thereby their operative positions, in which they are arrested by spring-loaded bolts 24, which engage into the recesses 25 disposed in the vicinity of the turning axis 21 in the wings 14.

The means for outwardly pivoting the wings 14 in accordance with the invention permit a mounting in a relatively compact space and operate also reliably after long storage or shelf lives with large acceleration loads.

Figure 6:
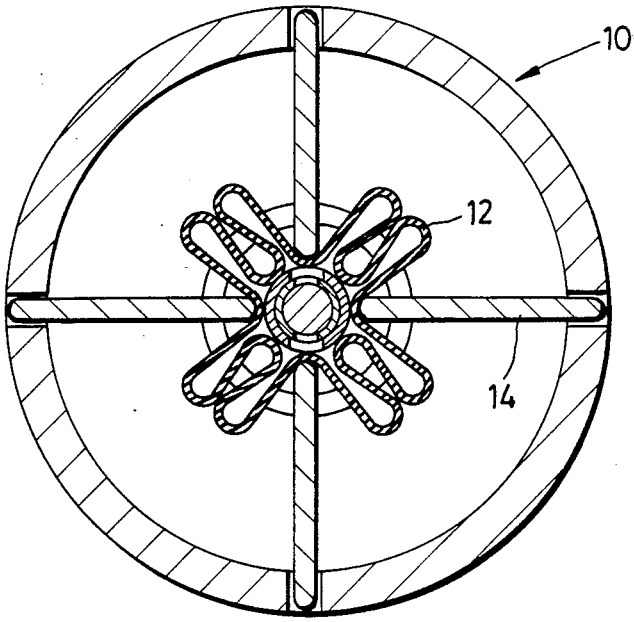
FIG. 6 is a cross-sectional view of an alternate embodiment of the invention.

According to a further embodiment of the invention, which is illustrated in FIG. 6 only by means of a schematic cross-sectional view, the wings 14 of the flight stabilization and guide means 102 can be slid inwardly in a radial direction within the housing of the missile body 100. The end pieces which confront the missile body axis are disposed on a collapsed expandable body 12 when this body is in its inoperative position (collapsed or folded). When this body 12 is blown up by means of gaseous pressure introduced therein it expands and thereby slides the wings 14 outwardly in a radial direction so that they reach their operative position.

The expandable body 12, 12' consists in all of the embodiments of the invention of a gas-tight material, which can withstand high pressures. A rubberized woven fabric has, for example, be found to be particularly suitable for such a use or a synthetic material forming the expandable body 12, 12' has been found to be suitable.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

I claim:

1. An improved missile body having first flight guide and stabilization means operatively mounted on the tail of the missile body and second flight guide and stabilization means operatively mounted on said missile body in front of said first guide and stabilization means with respect to the direction of flight of said missile body, said second flight guide and stabilization means including a plurality of pivotably mounted wings and means for radially outwardly unfolding said wings from an inoperative to an operative position; said means for radially outwardly unfolding said wings outwardly pivot said wings into an operative position against the direction of flight of said missile body; said missile body has a plurality of slits corresponding in number to the plurality of wings and said wings are fully disposed in said slits when said wings are in their inoperative positions said means for radially outwardly unfolding said wings include at least one inflatable air bag and a pressurized gaseous medium source in operative communication with said air bag, whereby when said plurality of wings are in their inoperative position said air bag is in a collapsed folded condition and said air bag assumes an essentially disk-like shape which is centered about the longitudinal axis of the projectile when inflated by said source of pressurized gaseous medium thereby biasing said plurality of wings outwardly of said missile body.

2. The improved missile body as set forth in claim 1, wherein said means for radially outwardly unfolding said wings include at least one inflatable air bag and a pressurized gaseous medium source in operative communication with said air bag, each one of said plurality of wings being pivotally mounted adjacent to one of its ends, whereby when said plurality of wings are in their inoperative position said air bag is in a collapsed folded condition and said air bag assumes an essentially disk-like shape when inflated by said source of pressurized gaseous medium thereby pivoting said plurality of wings outwardly of said missile body by pushing against each wing end which is opposite the end at which the wing is pivotally mounted.

3. The improved missile body as set forth in claim 2, including a pressurized gaseous medium cylinder forming said source of pressurized gaseous medium, gas communication conduits mounted in said missile body for selectively operatively communicating said pressurized gaseous medium cylinder with said inflatable air bag.

4. The improved missile body as set forth in claim 3, wherein each wing has a free end and including a first recess in the free end of each wing of said plurality of wings, first arresting means slidably movably mounted in said missile body and releasably holding each wing in its operative position by engaging each wing in said first recess.

5. The improved missile body as set forth in claim 4, including second arresting means operatively mounted in said missile body for maintaining each wing of said plurality of wings in its operative position.

6. The improved missile body as set forth in claim 5, wherein said second arresting means include a plurality of spring biased bolts corresponding in number to the plurality of wings, each wing including a second recess adjacent to the end where said wing is pivotally mounted, each one of said spring biased bolts engaging one of said plurality of wings in said second recess when said wing is in its operative position.

* * * * *